US005755325A

United States Patent [19]

Willhite et al.

[11] Patent Number: 5,755,325

[45] Date of Patent: May 26, 1998

[54] DISPLAY ASSEMBLY FOR EDIBLE AND NON-EDIBLE OBJECTS

[75] Inventors: Mary Gwen Willhite, Richardson; James M. Foxx, Dallas; Bobby D. Craig, Garland, all of Tex.

[73] Assignee: MGW Group, Inc., Dallas, Tex.

[21] Appl. No.: 791,826

[22] Filed: Jan. 30, 1997

Related U.S. Application Data

[63] Continuation-in-part of Ser. No. 517,147, Aug. 21, 1995, abandoned.

[51] Int. Cl.[6] ..... A47F 7/00

[52] U.S. Cl. ..... 206/443; 206/779; 47/41.15; 211/60.1; 220/636

[58] Field of Search ..... 206/443, 560–565, 206/775, 779; 211/13.1, 60.1; 47/41.01, 41.13, 41.15; 220/625, 630, 636

[56] References Cited

U.S. PATENT DOCUMENTS

| | | | |
|---|---|---|---|
| 1,611,589 | 12/1926 | Janusek | 47/41.01 |
| 1,664,436 | 4/1928 | Tonnesen | 47/41.13 |
| 3,158,524 | 11/1964 | Tong | 206/423 |
| 3,821,061 | 6/1974 | Schier | 220/630 |
| 3,981,099 | 9/1976 | Dziewulski | 220/630 |
| 3,990,179 | 11/1976 | Johnson et al. | 220/630 |
| 4,224,764 | 9/1980 | Dziewulski et al. | 220/630 |
| 5,474,206 | 12/1995 | Herring, Sr. | 220/636 |

FOREIGN PATENT DOCUMENTS

| | | | |
|---|---|---|---|
| 2083005 | 3/1982 | United Kingdom | 211/60.1 |

*Primary Examiner*—Paul T. Sewell
*Assistant Examiner*—Luan K. Bui
*Attorney, Agent, or Firm*—Thompson & Knight

[57] ABSTRACT

A display assembly for edible and non-edible objects includes a base, a container, multiple holders integrally mounted in the interior bottom surface of the container, and rods of varying lengths for insertion into the holders.

12 Claims, 4 Drawing Sheets

DISPLAY ASSEMBLY FOR EDIBLE AND NON-EDIBLE OBJECTS

CROSS REFERENCE TO RELATED APPLICATION

This is a continuation-in-part of application Ser. No. 08/517,147, filed Aug. 21, 1995, now abandoned.

FIELD OF THE INVENTION

This invention relates generally to containers, and more particularly to a display assembly for edible and non-edible objects.

DESCRIPTION OF THE PRIOR ART

Various companies manufacture and sell displays containing different objects. For example, florists sell arrangements of flowers with varying types, shapes, colors and numbers of flowers. Other companies sell arrangements of candy, chocolates or other edible items. Still other companies offer cookie "arrangements" to the public. Typically, the cookies are arranged like flowers in a container. Sometimes other non-edible items, such as toys or gift items are included in the arrangements.

There are various manufacturing methods used to create the display assemblies. In one manufacturing process, a container is lined with plastic film and plaster is poured into the lined container. Rods are inserted in various positions into the wet plaster. Later, after the plaster dries, the edible and/or non-edible objects are attached to the ends of the rods fixed in the plaster.

In an alternate manufacturing process, the display items are initially fixed to the end of a rod or some other object. Then the items are secured to the inside of the container using some type of fastening means. For example, wire, netting or plaster may be placed in the bottom of the container. Thereafter, the rods with the attached items are inserted into holes in the wire, netting or plaster in a predetermined arrangement. The rods are sometimes secured to the wire or netting for additional support.

Alternatively, the rods may be inserted into foam or clay positioned in the bottom of the container. Materials such as tissue paper or other paper products may also be distributed around the rods to secure them in the predetermined arrangement.

The type of container used in the display assembly also varies. For example, the items may be displayed in wooden or straw containers.

While the above-described assemblies and manufacturing methods have merit, there are disadvantages associated with each. For example, if wire or netting is used, the wire or netting is usually not secured to the bottom of the container. Thus, the wire or netting may become dislodged following assembly. In addition, the wire/netting may be visible and must be disguised prior to presentation of the display assembly.

Due to the weight of a particular display item on one end of a rod, the other end of the rod may slip out of position or otherwise become dislodged following assembly. Similarly, the foam or clay may become dislodged following assembly. Other materials that are used to secure the rods in place are not secured to the interior of the container and may also become dislodged following assembly. Moreover, the foam or clay must be covered to prevent its exposure during presentation of the arrangement.

The above-described assembly methods are also labor intensive. Container manufacture is subject to error, especially when numerous individual steps are required. For example, an assembler may have to insert the foam, clay, wire, etc.; determine how to arrange the rods in the container; and then position the rods in the selected arrangement. These steps require additional time and increase the cost of assembly.

The plaster manufacturing method has some disadvantages. The process of affixing the rods into the container using plaster may be messy. Plaster sometimes causes skin irritations or burns. The assembler must prepare the plaster mixture correctly or it will not "set." The assembler must insert the rods quickly in the proper arrangement before the plaster dries. In addition, after the rods are inserted into and affixed to the container, the containers may require significant amounts of storage space to maintain an inventory of various sized containers.

The type of container may also be problematic. Wooden and straw containers have certain disadvantages. Wooden containers may be heavy even when empty, and their weight is increased by the addition of the display items to the container. In addition, the purchaser often discards the container following presentation of the arrangement. This affects the cost of the display assembly because wooden containers are typically more expensive than other types of containers.

Straw containers also have disadvantages. They are often manufactured in foreign countries. Weather related problems in such countries often decrease the availability of straw and therefore, straw containers. This is particularly a problem during peak selling seasons such as holidays.

Thus, there is a need for a display assembly and method that overcomes the disadvantages associated with the prior art assemblies and methods.

SUMMARY OF THE INVENTION

The present invention provides an improved display assembly for edible and non-edible objects. The assembly includes a container having a bottom member with an interior surface and an exterior surface. Multiple elongated tubular holders are integrally and perpendicularly mounted to the interior bottom surface of the container in a predetermined pattern. The tubular holders include a plurality of first holders having a circular cross section with an inside diameter, and plurality of second holders having an oval cross section with an inside minor axis substantially equal to the inside diameter of the first holders, and a major axis greater than said minor axis.

Multiple rods having a circular cross section and an outside diameter substantially equal to said inside diameter of the first holders are insertable into the multiple holders. Accordingly, rods inserted into the first holders extend perpendicularly outwardly from the interior bottom surface of the container, and rods inserted into said second holders extend at a predetermined non-perpendicular first angle outwardly from the bottom surface of the container.

The display assembly of the present invention includes a base detachably mounted to the container. The container includes a plurality of locking tabs extending outwardly from the exterior surface of the bottom member. The base includes a top surface formed to define a plurality of slots engageable with the locking tabs to detachably interlock said base and said container.

Preferably, the container is round and has a frusto-conical side wall that flares outwardly from the bottom member to form a top opening having a diameter greater than the diameter of the bottom member. The base is round and has a diameter substantially equal to the diameter of the top opening of the container, so as to increase the stability of the display assembly.

BRIEF DESCRIPTION OF THE DRAWINGS

For a more complete understanding of the present invention and the advantages thereof, reference is now made to the following Detailed Description of the Invention, taken in conjunction with the accompanying Drawings in which.

DESCRIPTION OF THE PREFERRED EMBODIMENT

Figure 1:
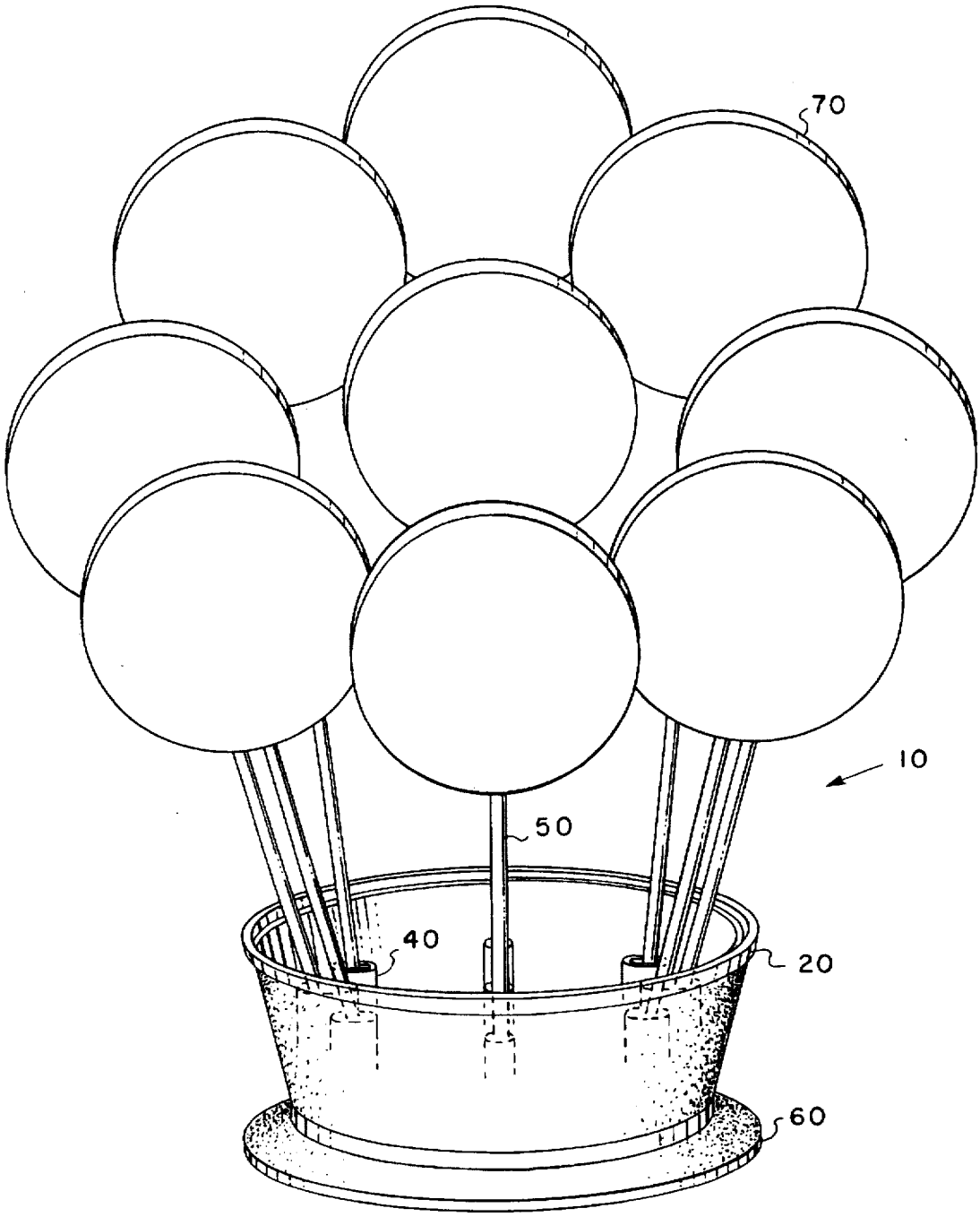
FIG. 1 Is a perspective view of a display assembly according to the present invention, illustrating the display following assembly.
Figure 2:
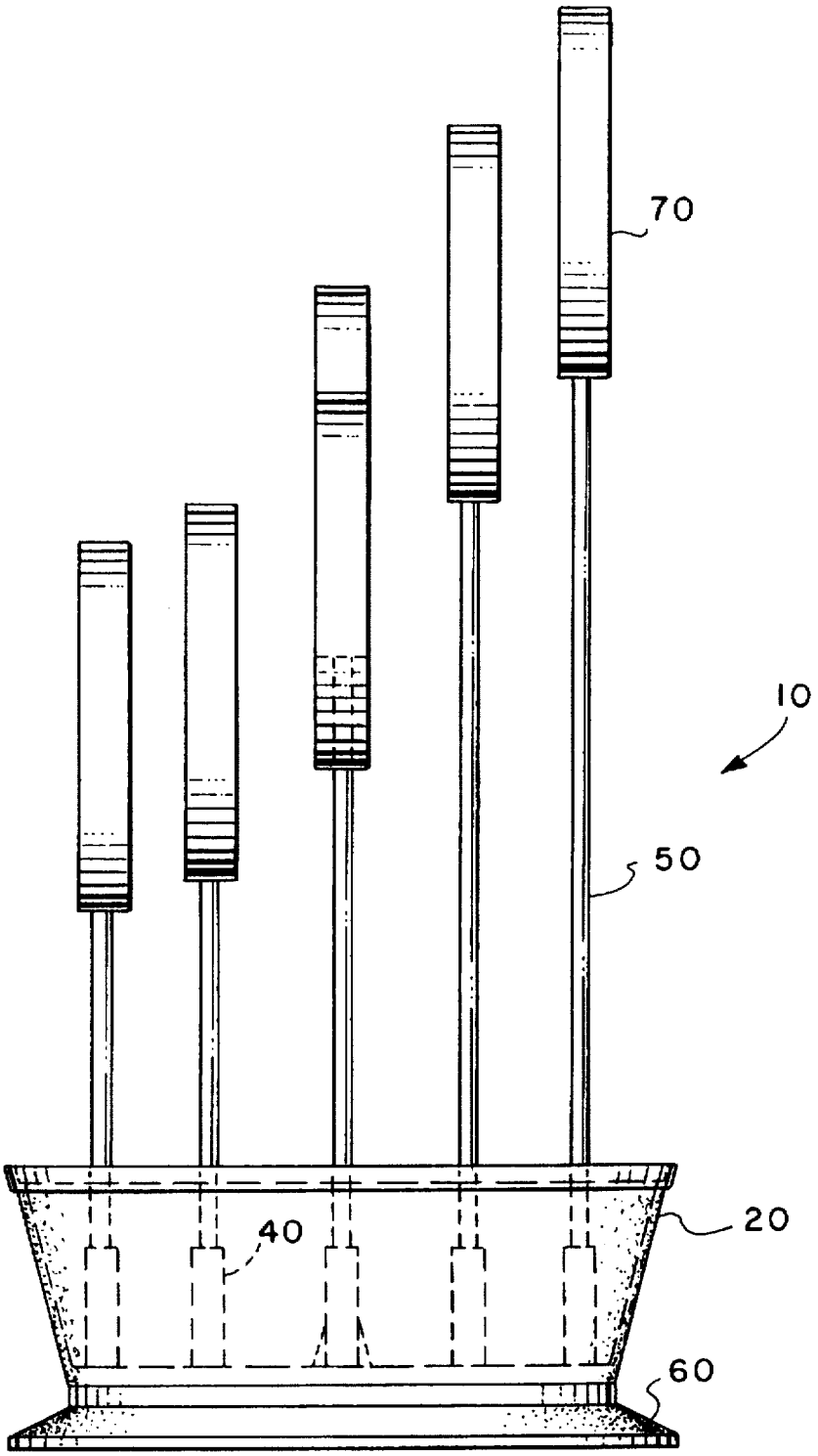
FIG. 2 is a side view of the display assembly of FIG. 1.

Referring now to the Drawings, and first to FIGS. 1 and 2, the display assembly of the present invention is designated generally by the numeral 10. Display assembly 10 includes a container 20, multiple holders 40, multiple rods 50, a base 60 and edible and/or non-edible objects 70.

Display assembly 10 may be used to display various edible items such as cookies, candy or chocolates. Alternatively, the display assembly may display non-edible items, such as toys, baby and/or gift items. A combination of edible and non-edible items may also be used. The items must be capable of attachment to the rods in the assembly and must be lightweight. For purposes of illustration only, the display assembly will be described using cookies as the display items 70. It will be understood, however, by one skilled in the art, that other items are also contemplated by the present invention and may be substituted for the cookies.

Container 20 is constructed of plastic or another lightweight material known in the industry. The plastic or other material may be modified to provide a smooth and/or shiny appearance. Preferably, the container 20 has a satin-type finish. In the preferred embodiment, the container is manufactured of polypropylene.

Container may be constructed of various shapes. In the preferred embodiment, container 20 is round. Other shapes such as oval or square (not shown) may also be used, as desired.

Figure 3:
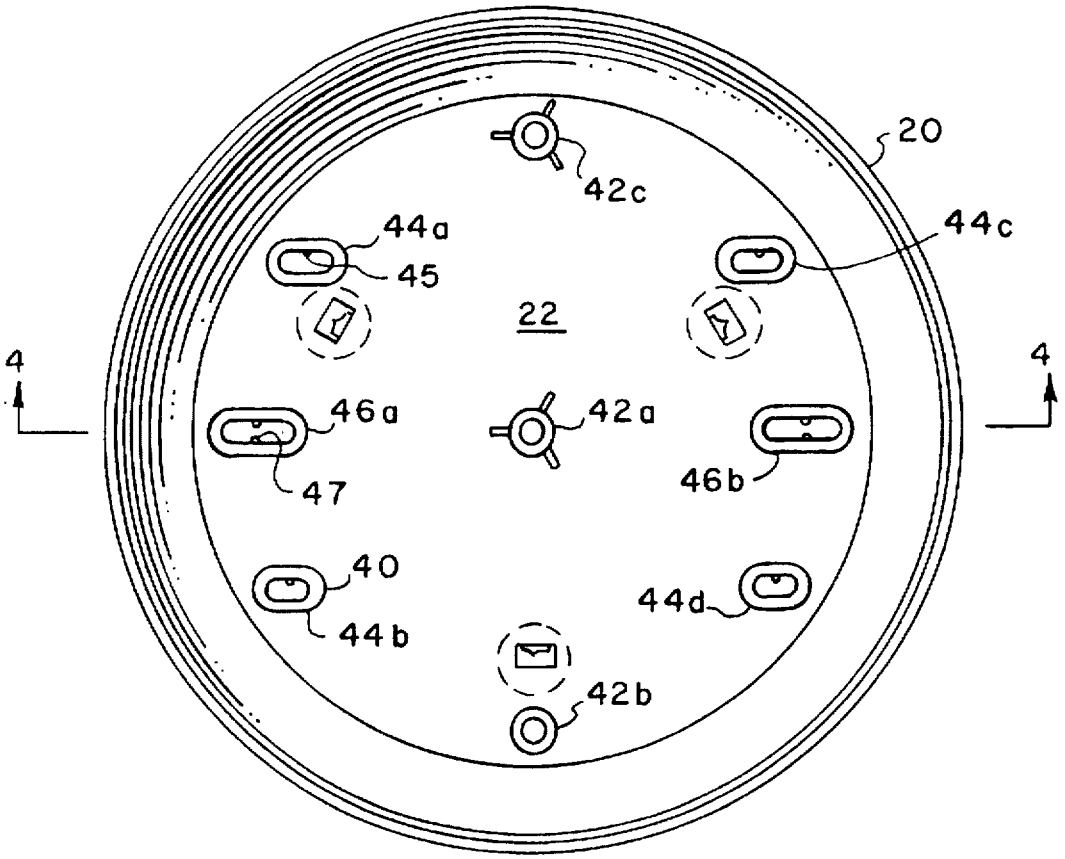
FIG. 3 is a top view of the container of the present invention, illustrating the spatial arrangement of the holders.
Figure 4:
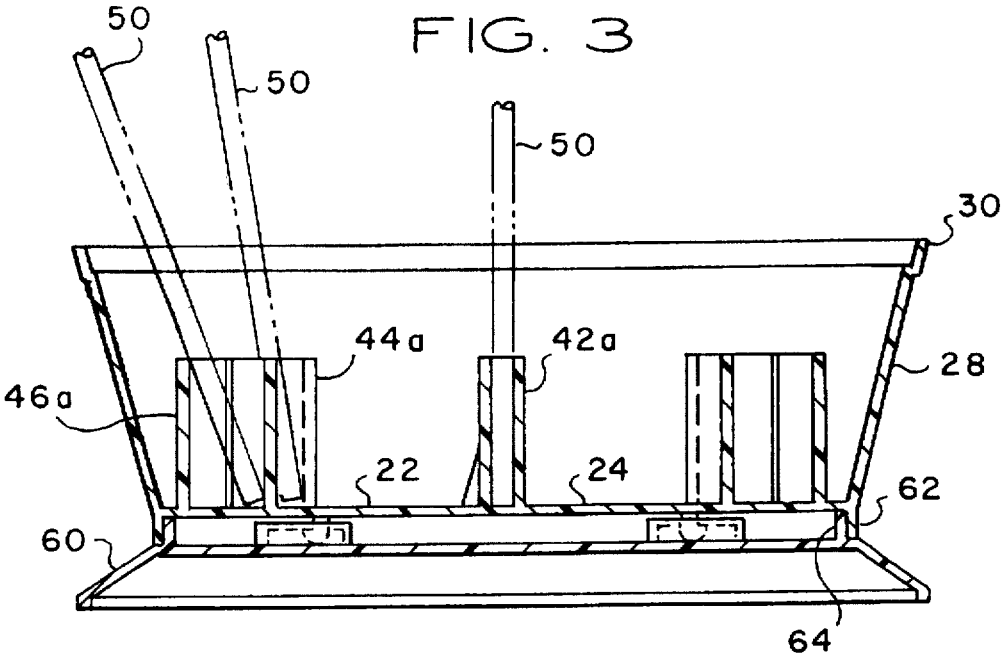
FIG. 4 is a sectional view of the container of the present invention taking along line 4—4 of FIG. 3.
Figure 5:
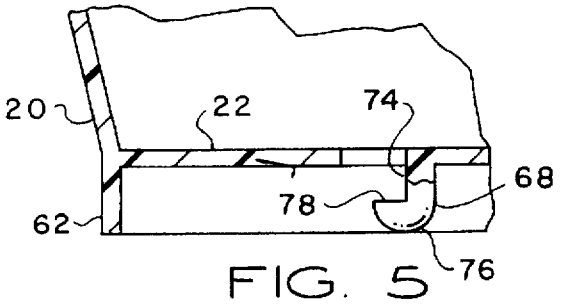
FIG. 5 is a fragmentary sectional view taken along line 5—5 of FIG. 6 showing details of container according to the present invention.
Figure 6:
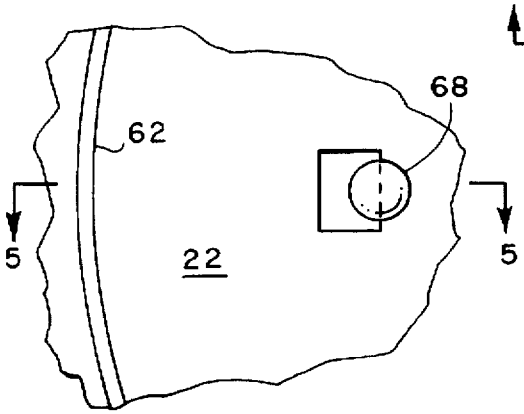
FIG. 6 is a fragmentary bottom view of the container of the present invention.
Figure 7:
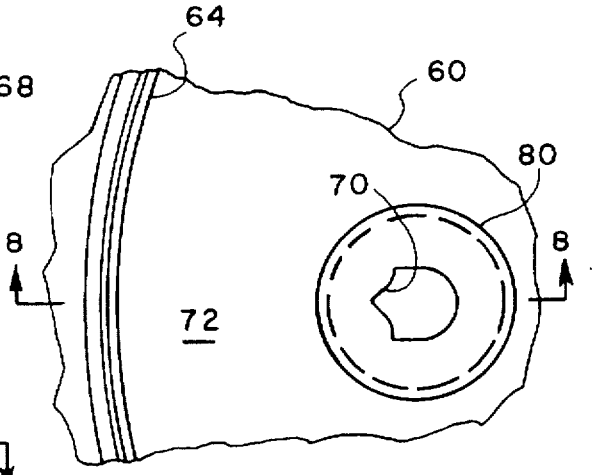
FIG. 7 a fragmentary top view of the base of the present invention.
Figure 8:
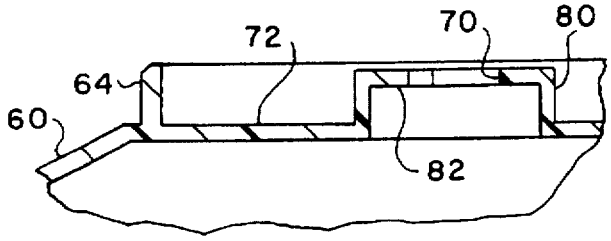
FIG. 8 is a fragmentary sectional view taken along line 8—8 of FIG. 7.

As is best shown in FIGS. 3 and 4, container 20 includes a bottom member 22 having an interior surface 24 and an exterior surface 26. Side members 28 are connected to the bottom member 22. If the container 20 is round, there is a single continuous side member 28 around the container 20. If the container 20 is square or rectangular, multiple side members 28 will be present.

As shown in FIG. 4, side members 28 extend upwardly from the bottom member 22. Preferably, the side members 28 also flare outwardly from the bottom member 22. In other words, if a round container 20 is used, side member 28 is frusto-conical and the circumference of the container 20 at the opening is greater than the circumference of the bottom member 22.

The container 20 may include a lip 30. The lip 30 is fixed to the side members 28 at the opening of the container 20. The lip 30 partially overlies the side members 28.

Multiple holders 40 are positioned on the interior surface 24 of the bottom member 22. The holders 40 are manufactured of the same material used in constructing the container 20. In the preferred embodiment, the holders 40 are integrally mounted to the interior surface 24 of the bottom member 22.

The holders 40 are positioned at or near the intersection of the side members 28 and the bottom member 22. If a round container 20 is used, the holders 40 are positioned near the circumference of the bottom member 22. The holders 40 may be arranged closer to the center of the bottom member 22 if desired.

As best shown in FIG. 3, holders 40 are constructed of varying shapes. Container 20 includes a plurality of first holders 42 having a circular cross section. First holders 42 have an inside diameter substantially equal to the outside diameter of rods 50. Thus a rod 50 inserted into a first holder 42 extends perpendicularly outwardly from interior surface 24 of bottom member 22, as shown in phantom in FIG. 4. In the preferred embodiment, container 20 includes three first holders 42, although it will be recognized that more or fewer first holders may be included.

Container also includes a plurality of second holders 44. Second holders have an oval inside cross section having a minor axis, with a length substantially equal to the inside diameter of the first holders 42, and a major axis, with a length preferably about twice the inside diameter of first holder 42. Second holders 44 each include an integrally formed detent 45, which acts to hold rod 50 firmly in place. During assembly, a rod 50 is inserted into a second holder 42 along its inside edge and perpendicular to bottom member 23. Rod 50 is then snapped outwardly to a non-perpendicular angle with respect to bottom member 23, as shown in phantom in FIG. 4. In the preferred embodiment, container 20 includes four second holders 44, although it will be recognized that more or fewer first holders may be included.

Container finally includes a plurality of third holders 46. third holders have an oval inside cross section having a minor axis, with a length substantially equal to the inside diameter of the first holders 42, and a major axis, with a length preferably about three times the inside diameter of first holder 42. Third holders 44 each include a pair of integrally formed detents 47, which acts to hold rod 50 firmly in place. During assembly, a rod 50 is inserted into a third holder 46 along its inside edge and perpendicular to bottom member 23. Rod 50 is then snapped outwardly to a non-perpendicular angle with respect to bottom member 23 that is greater than the angle of the rods 50 inserted into second holders 44, as shown in phantom in FIG. 3. In the preferred embodiment, container 20 includes two third holders 46, although it will be recognized that more or fewer first holders may be included.

Thus, by inserting rods of the same outside diameter but of different lengths into holders 40 an arrangement as shown in FIG. 1 may be formed. It will be noted that all of the holders 40 extend perpendicularly outwardly from bottom member 22 so that container 20 may be formed by molding. However, because of the unique form of second holders 44 and third holders 46, rods 50 extend outwardly from bottom member 22 at non-perpendicular angles. Accordingly, when rods 50 are placed in first holders 42*a*, 42*b* and/or 42*c*, the rods 50 will be upright. When rods 50 are placed in second holders 44*a*, 44*b*, 44*c* and/or 44*d*, the rods 50 will lean at a predetermined angle from vertical. Finally, when the rods 50 are inserted into third holders 46*a* and/or 46*b*, the rods 50 will lean at a larger angle from vertical than the rods 50 placed in second holders 44.

In the preferred embodiment, the purchaser of the cookie display may select up to nine cookies or other articles 70 to be included in the display assembly 10. Typically, the purchaser will select from three to nine cookies. The predetermined arrangement of the holders 40 permits the assembler to arrange the cookies in the container 20 so that the assembly 10 has a pleasing appearance regardless of the number of cookies 70 in the display 10.

The rods 50 may be manufactured of wood, plastic or another material. The material must be sufficiently strong to hold a cookie or other item 70 on one end. In addition, the material must be acceptable for receipt of a food item if only edible items are being displayed. In the preferred embodiment, the rods 50 are wooden. Alternatively, the rods 50 may be manufactured of plastic similar to the container or another material. Preferably, the rods 50 have a circular cross section with an outside diameter substantially equal to the inside diameter of first holders 42, however, other shapes may also be used. If other shapes are used, then the shapes to the holders must be made to conform to the shape of the rods.

In order to enhance the stability, display assembly 10 also includes a base 60. Base 60 is constructed of the same material used for the container 20. The material used to construct the base 60 may also be modified as described above to provide a smooth appearance. Base 60 may have various shapes. The preferred embodiment display assembly 10 includes a round base 60 having a diameter substantially equal to the diameter of lip 30 of container 20.

Preferably, base 60 is manufactured as a separate part that is attachable to container 20. As shown in FIG. 4, and in detail in FIGS. 5–9, container 20 includes an axially extending cylindrical rim 62 that matingly engages an axially extending cylindrical rim 64 formed on base 60. Cylindrical rims 62 and 64 are held in mating engagement with each other by means of locking tabs 68 carried by bottom member 22 of container 20 that lockingly engage slots 70 defined in the top 72 of base 60.

Figure 9:
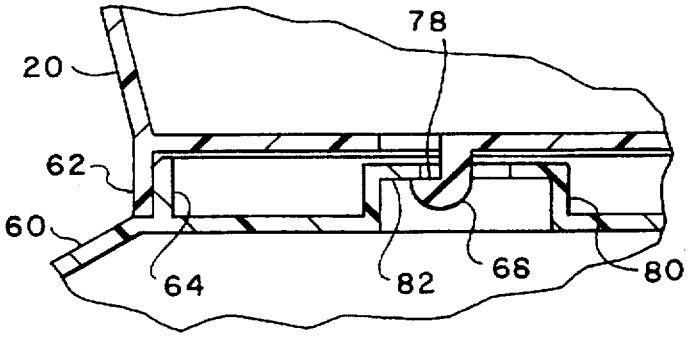
FIG. 9 is a fragmentary sectional view showing the connection of the container to the base according to the present invention.

Each locking tab 68 includes a flexible arm 74, a spherical camming surface 76, and a locking surface 78. Each slot 70 is carried by a cylindrical boss 80 that extends axially outwardly from top 70 of base 60. As best shown in FIG. 3, there are preferably three locking tabs 68 and slots 70 space about 120 degrees apart. Base 60 is attached to container 20 by aligning locking tabs 68 and slots 70 and pushing base 60 axially with respect to container 20. Camming surfaces 76 cooperate with slots 70 to flex arms 74 inwardly until locking surface 78 snaps into place in engagement with bottom surface 82 of boss 80, as shown in FIG. 9.

From the foregoing, it will be seen that the present invention provides an aesthetically pleasing display assembly that is efficient to manufacture and easy to assemble. Container 20 and base 60 are separately molded, but they snap together to make a mechanically stable assembly. Holders 40 are all perpendicular to bottom member 22 so that container 20 may be molded easily, but their shapes allow selected rods 50 to extend outwardly at predetermined non-perpendicular angles.

Although a preferred embodiment of the present invention has been illustrated in the accompanying drawing figures and described in the foregoing Description of the Preferred Embodiment, it will be understood that the invention is not limited to the embodiments disclosed, but is capable of numerous rearrangements, modifications and substitutions of parts and elements without departing from the spirit of the invention.

What is claimed is:

1. A display assembly for edible and non-edible objects, comprising:

a container, said container including a bottom member with an interior surface and an exterior surface;

multiple elongated, tubular holders integrally and perpendicularly mounted to the interior bottom surface of the container in a predetermined pattern, said multiple elongated, tubular holders including a plurality of first holders having a circular cross section with an inside diameter, and plurality of second holders having an oval cross section, each of said second holders including a pair of substantially straight substantially parallel side walls space apart from each other a distance substantially equal to said inside diameter and a pair of end walls space apart from each other a distance greater than inside diameter; and multiple rods having ends and a circular cross section with an outside diameter substantially equal to said inside diameter of said first holders for insertion into the multiple holders, said multiple rods including first rods inserted into said first holders to extend perpendicularly outwardly from the interior bottom surface of the container, and second rods inserted into said second holders, each with one end engaging one of said end walls and said bottom surface of said container and a portion of said second rod between said ends engaging the other of said end wall, whereby said second rods lean at a predetermined non-perpendicular first angle outwardly from the bottom surface of the container.

2. The display assembly as claimed in claim 1 including a base mounted to the container.

3. The display assembly as claimed in claim 2 wherein the base is detachable.

4. The display assembly as claimed in claim 3, wherein:

said container includes a plurality of locking tabs extending outwardly from the exterior surface of said bottom member; and, said base includes a top surface with a plurality of outwardly extending cylindrical members, each of said cylindrical members having a length and substantially flat end, each of said flat ends having a slot formed therein, said slots being engageable with said locking tabs to detachably interlock said base and said container.

5. The display assembly as claimed in claim 4, wherein:

said container includes a rim extending axially outwardly from said exterior surface of said bottom member a distance substantially equal to the length of said cylindrical members; and, said base includes a rim extending axially outwardly from top surface of said bottom member a distance substantially equal to the length of said cylindrical members, said rim of said base being engageable with said rim of said container.

6. The display assembly as claimed in claim 3 wherein:

the container is round and has a frusto-conical side wall that flares outwardly from said bottom member to form a top opening having a diameter greater than the diameter of said bottom member; and, said base is round and has a diameter substantially equal to the diameter of the top opening of the container.

7. The display assembly as claimed in claim 1, including:

a plurality of third holders having an oval cross section, each of said third holders including a pair of substantially straight substantially parallel side walls spaced apart from each other a distance substantially equal to said inside diameter and a pair of end walls spaced apart from each other a distance greater than the spacing of said end walls of, whereby third rods inserted into said third holders with an end engaging one of said end wall of said third holder and said bottom surface and a portion of said third rod between said ends engaging the other end wall lean at a predetermined non-perpendicular second angle outwardly from the bottom surface of the container, said second angle being greater than said first angle.

8. The display assembly as claimed in claim 1 wherein the rods have varying lengths.

9. A display assembly for edible and non-edible objects, comprising:

a base;

a container detachably mounted to the base, said container comprising:

a bottom member having an interior surface and an exterior surface; and side surfaces connected to and extending upwardly from the bottom member;

a plurality of first holders having a circular cross section and an inside diameter, said first holders being integrally and perpendicularly mounted to the interior surface of the bottom member of the container in a predetermined pattern;

a plurality of first rods insertable into the first holders, said first rods having circular cross section and an outside diameter substantially equal to the inside diameter of said first holders, such that rods inserted into said first holders extend perpendicularly outwardly from the interior bottom surface of the container;

a plurality of second holders, each of said second holders including a pair of substantially straight substantially parallel side walls spaced apart from each other a distance substantially equal to the inside diameter of the first holders and a pair of end walls spaced apart from each other a distance greater than the inside diameter of the first holders, said second holders being integrally and perpendicularly mounted to the interior surface of the bottom member of the container in a predetermined pattern; and a plurality of second rods insertable into said second holders, each of said second rods having a pair of ends and a circular cross section with an outside diameter substantially equal to the outside diameter of said first rods such that second rods inserted into said second holders with one end engaging one of said end walls and said bottom surface and a portion of said second rod intermediate said end engaging the other of said end walls lean at a non-perpendicular angle outwardly from the bottom surface of the container.

10. A display container, comprising:

a bottom member with an interior surface and an exterior surface, said bottom member including a plurality of locking tabs extending outwardly from the exterior surface of said bottom member;

multiple elongated tubular holders integrally and perpendicularly mounted to the interior surface of said bottom member in a predetermined pattern; and a base member including a top surface with a plurality of outwardly extending cylindrical members, each of said cylindrical members having a length and substantially flat end, each of said flat ends having a slot formed therein, said slots being engageable with said locking tabs to detachably interlock said base and said container.

11. The display container as claimed in claim 10, including:

a rim extending axially outwardly from said exterior surface of said bottom member a distance substantially equal to the length of said cylindrical members, said rim of said bottom member being engageable with said base; and, said base includes a rim extending axially outwardly from top surface of said bottom member a distance substantially equal to the length of said cylindrical members, said rim of said base being engageable with said bottom member.

12. The display container as claimed in claim 10, wherein said bottom member is round and said container includes:

a frusto-conical side wall that flares outwardly from said bottom member to form a top opening having a diameter greater than the diameter of said bottom member; and wherein, said base is round and has a diameter substantially equal to the diameter of the top opening of the container.

* * * * *